United States Patent [19]

Palka et al.

[11] Patent Number: 4,884,176

[45] Date of Patent: Nov. 28, 1989

[54] TRI-VIEW MIRRORED CABINET WITH PERIPHERAL LIGHTING

[75] Inventors: James J. Palka, Kildeer; Robert B. Rekart, Villa Park, both of Ill.

[73] Assignee: Pace Industries, Inc., Chicago, Ill.

[21] Appl. No.: 200,364

[22] Filed: May 31, 1988

[51] Int. Cl.[4] ..... F21V 33/00

[52] U.S. Cl. ..... 362/135; 362/141; 362/142

[58] Field of Search ..... 362/127, 128, 129, 135, 362/140, 141, 142, 133

[56] References Cited

U.S. PATENT DOCUMENTS

| | | | |
|---|---|---|---|
| Re. 25,402 | 6/1963 | Myerberg | 362/141 |
| 1,948,111 | 2/1934 | Hoegger | 362/129 |
| 2,201,251 | 5/1940 | Van Patten | 362/141 |
| 3,038,771 | 6/1962 | Schwartz et al. | 362/128 |
| 3,936,669 | 2/1976 | Gardner | 362/141 |

FOREIGN PATENT DOCUMENTS

| | | | |
|---|---|---|---|
| 648296 | 12/1928 | France | 362/141 |
| 1276169 | 10/1960 | France | 362/141 |

*Primary Examiner*—Ira S. Lazarus
*Assistant Examiner*—Sue Hagarman
*Attorney, Agent, or Firm*—Wall and Roehrig

[57] ABSTRACT

A lighted tri-view medicine cabinet which may be mounted on a wall surface. Three access doors are provided to the cabinet interior, each of which has an outer mirrored surface so that the two outer doors may be pivoted relative to the central door for facilitating full face reflective viewing. A soft diffused light is provided about the entire peripheral surface of the cabinet, such that the aesthetic appearance of the cabinet is enhanced as well as providing a source of soft diffused light which may be reflectively applied to the face of a person using the cabinet by the positioning of the outer reflective surface of the cabinet doors.

2 Claims, 2 Drawing Sheets

TRI-VIEW MIRRORED CABINET WITH PERIPHERAL LIGHTING

BACKGROUND OF THE INVENTION

This invention relates in general to medicine cabinets, and, in particular, to a medicine cabinet having lamps positioned about its entire outwardly facing periphery. More specifically, but without restriction to the particular embodiment and/or use which is shown and described for purposes of illustration, this invention relates to a mirrored medicine cabinet having soft diffused lighting emitted about its entire peripheral edges and enabling the mirrored portions of the cabinet to be positioned to provide full-face viewing with varying light exposure on one using the cabinet mirrors.

Medicine cabinets for use in a bathroom are available in various configurations, and may be mounted either free standing on the interior wall of a bathroom, or mounted into the bathroom wall to provide a more flush appearance. Some of these cabinets are available in a multitude of designs and configurations to enhance the aesthetics of a bathroom or powder room. Such cabinets are available in a tri-view mirrored configuration wherein the cabinet is closed by three doors having their outer surface mirrored. These mirrored doors may be positioned to provide a full face image to the viewer, covering both the frontal reflection of the face and portions of the side of the head which may be varied in accordance with the positioning of the mirrors. In other tri-view mirrored cabinets, the cabinet enclose is closed by a single door having an outer mirrored surface. One of a pair of wing mirrors is positioned and supported at each side of the cabinet to be positioned by the viewer for the same purpose.

In order to better utilize these mirrors, they are sometimes combined with separate overhead lamps, such as individual lamps, positioned above the upper peripheral edge of the mirror. With some cabinets, a vertically disposed lamp is positioned between the central mirrored surface and each adjacent side mirror along the joinder portion so that light can be projected against a user to minimize unwanted shadowing, or to increase the light directed onto the face of a user as desired.

These prior art medicine cabinets, however, have not been entirely satisfactory in that the light is not uniformly applied. The light that is applied to a user is generally harsh, and frequently creates undesirable shadowing on the user's face. The present invention provides soft or diffused lighting about the entire peripheral edge of the medicine cabinet. In combination with the positioning of the mirrored cabinet doors, this lighting also eliminates the projection of harsh light onto a user. A soft or diffused light is provided which may be directed onto the user's face minimizing shadowing, enhancing the aesthetic appearance of the cabinet, and providing a soft diffused light to be applied to a person using the mirrors.

SUMMARY OF THE INVENTION

It is, therefore, an object of this invention to improve medicine cabinets.

Another object of this invention is to provide uniform softly diffused light about the entire peripheral surface of a medicine cabinet.

A further object of this invention is to permit the application of a soft diffused reflective light onto a person using the medicine cabinet mirrors.

Still another object of this invention is to improve the aesthetic appearance of a medicine cabinet by providing a halo of soft light about its peripheral edges which may be selectively applied to the reflective image of the user.

These other objects are attained in accordance with the present invention wherein there is provided a lighted tri-view medicine cabinet which may be mounted on a wall surface. Three access doors are provided to the cabinet interior, each of which has an outer mirrored surface so that the two outer doors may be pivoted relative to the central door for facilitating full face reflective viewing. A soft diffused light is provided about the entire peripheral surface of the cabinet, such that the aesthetic appearance of the cabinet is enhanced as well as providing a source of soft diffused light which may be reflectively applied to the face of a person using the cabinet by the positioning of the outer reflective surface of the cabinet doors.

DESCRIPTION OF THE DRAWINGS

Further objects of the invention together with additional features contributing thereto and advantages occurring therefrom will be apparent from the following description of a preferred embodiment of the invention which is shown in the accompanying drawings with like reference numerals indicating corresponding parts throughout, wherein.

DESCRIPTION OF A PREFERRED EMBODIMENT

Figure 3:
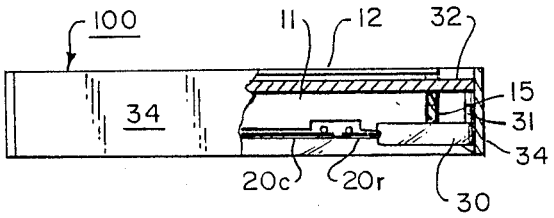
FIG. 3 is a top plan of FIG. 1 with portions broken away to better illustrate the positioning of the lamps.
Figure 6:
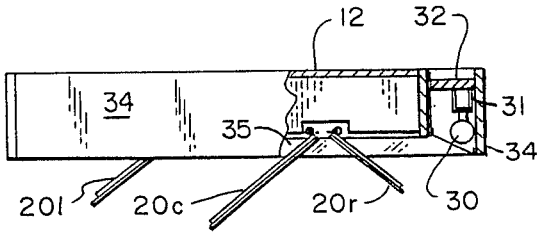
FIG. 6 is a top plan view of the cabinet illustrated in FIG. 2 with the side doors closed and the center door open to better illustrate one manner in which the peripheral light may be applied to a user.
Figure 1:
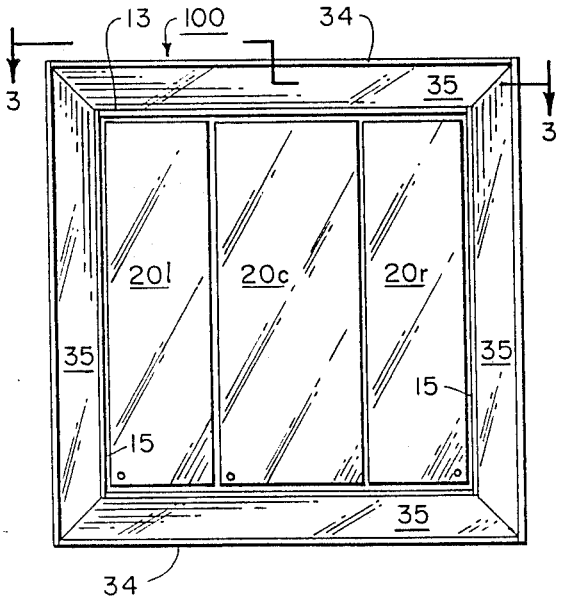
FIG. 1 is a front elevational view of a mirrored cabinet having lamps on all four sides.
Figure 2:
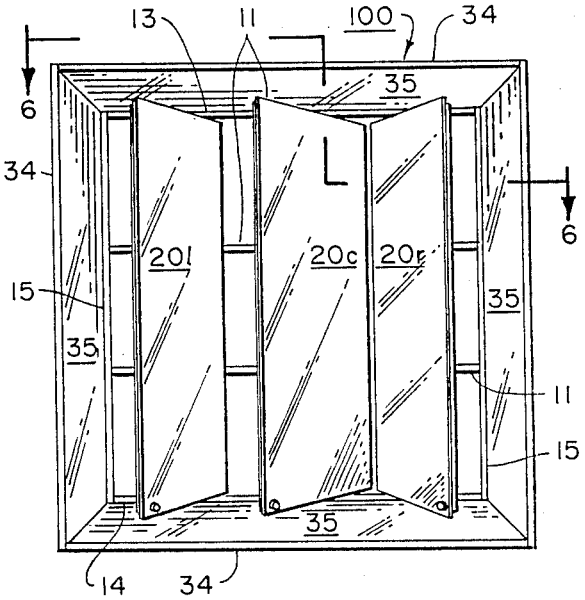
FIG. 2 is a front elevational view of the mirrored cabinet with the doors opened.
Figure 4:
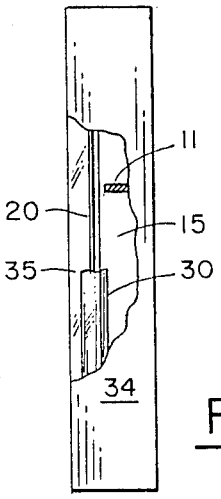
FIG. 4 is a side elevational view of FIG. 1 with portions broken away to better illustrate the positioning of the lamps.
Figure 5:
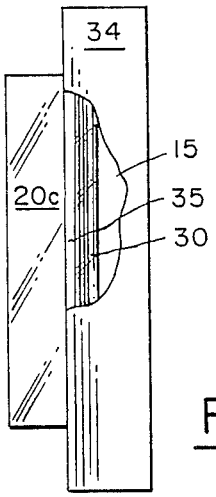
FIG. 5 is a side elevational view of the cabinet illustrated in FIG. 2 with the side cabinet doors closed and the center cabinet door open to better illustrate one manner in which light may be reflected onto a user.

Referring now to FIGS. 1 and 2, there is illustrated a medicine cabinet 100 which may be mounted onto a wall surface. The cabinet 100 has three doors 20 each of which has an outer mirrored surface. In the preferred embodiment illustrated, the right side door 20 r is pivoted about its left edge or side, and the center and left door 20 c and 20 l, respectively are each pivoted about their right edge or side. In this manner the two outer doors, 20 l and 20 r, may be pivoted toward each other when the center door is closed, for tri-view reflection, or an individual door may be pivoted outwardly as desired.

As best illustrated in FIG. 2, the interior of the cabinet 100 is illustrated as having two shelves 11 which are appropriately secured or positioned within the cabinet enclosure. The cabinet enclosure is formed with an open front which is selectively closed by the positioning of the mirrored doors 20 and comprises a back or rear wall 12, a top wall 13, a bottom wall 14, and two side walls 15. Each of the doors 20 has an outer mirrored surface, and each door is pivotally supported at one side within the opening formed in the front of the cabinet. When the doors 20 are closed into a position adjacent to one another in the opening, as illustrated in FIG. 1, the doors form a mirrored surface closing the cabinet interior. While various types of hinged connections may be utilized to support the doors 20 for pivotal movement relative to the cabinet closure, a pivot such as disclosed in James J. Palka U.S. Pat. No. 4,412,708 may be utilized, and the disclosure thereof is incorporated herein by reference.

Surrounding the outer peripheral portion of the cabinet enclosure is a plurality of fluorescent lamps 30 which are of a sufficient length to extend beyond the height and width of the cabinet enclosure. While four fluorescent lamp tubes 30 are utilized in the preferred embodiment illustrated, it is to be understood that a greater number of shorter tubes could be utilized so long as a source of soft light is provided about the entire periphery of the cabinet closure. The lamp tubes 30 are supported at each end by conventional fluorescent lamp connectors 31 which in turn are carried upon a support panel 32 connected to the side wall 15 or the top wall 13 or bottom wall 14 depending upon the particular positioning of the corresponding fluorescent lamp tube either at the sides, top or bottom, respectively.

Figure 7:
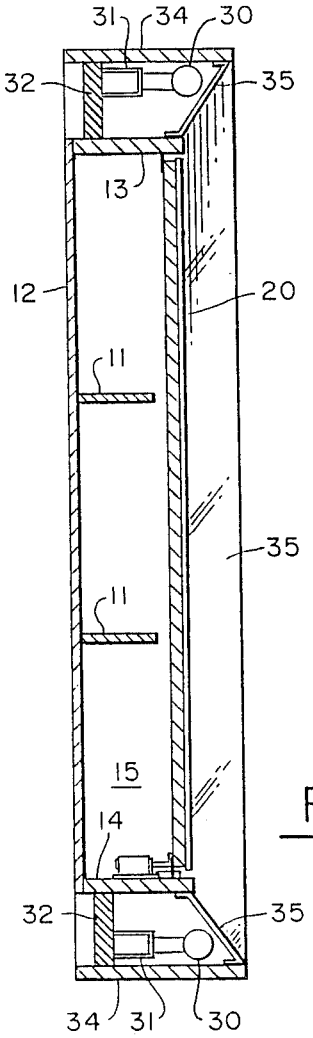
FIG. 7 is an enlarged cross sectional view of the cabinet illustrated in FIG. 1, taken along the line 7—7.
Figure 8:
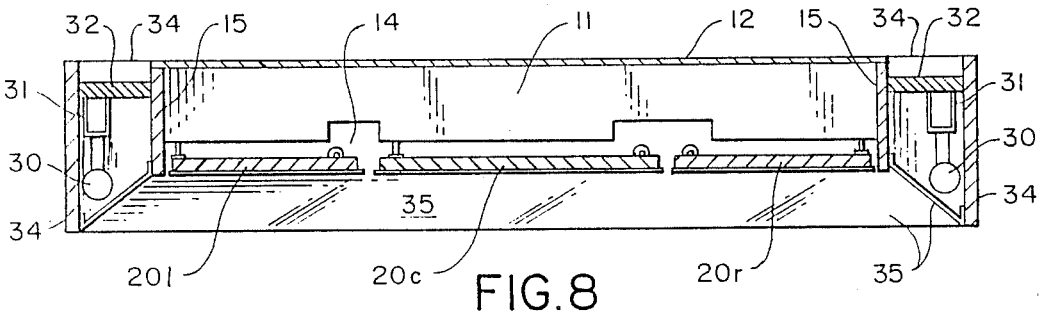
FIG. 8 is an enlarged cross sectional view of the cabinet shown in FIG. 1, taken along line 8—8.

The support panels 32 extend outwardly about the outer periphery of the cabinet enclosure and are secured to the cabinet on one side and at the other side thereof support a finishing panel 34 which is spaced outwardly from each of the top, bottom and side walls of the cabinet enclosure to form a chase wherein the fluorescent lamp tubes 30 are positioned. As best illustrated in FIGS. 7 and 8, the finishing panels 34 each extend outwardly from the rear of the cabinet a greater distance than the mirrored cabinet doors 20. The chase or space defined between the inner edge of the finishing panels and the outer edge of the top wall 13, bottom wall 14, and side walls 15 is closed by a translucent panel 35 which covers each of the fluorescent lamp tubes 30. The translucent panels 35 are joined at their intersecting corners by an outwardly opening mitered corner, providing a pleasing aesthetic appearance. A plurality of clips are carried on the finishing panels and the cabinet walls to retain the translucent panels in position.

The fluorescent lamp tubes 30 are positioned about the periphery of the cabinet enclosure with a portion of the lamp tubes extending forwardly beyond the outermost edge of the top wall 13, bottom wall 14 and side walls 15. In this manner the light from the fluorescent lamp tubes is projected outwardly beyond the enclosure walls minimizing any shadow that might be created by light impinging on portions of these walls. The positioning of the fluorescent lamp tubes, and the use of the outwardly flaring translucent panels 35 created in the appearance of a soft halo effect about the medicine cabinet, and provides a source of soft diffused light for reflective images in the cabinet mirrors. The positioning of the mirrored cabinet doors 20 reflects the uniform soft light provided by the lamp positioning and the translucent panels, such that the mirrors can project various lighting effects on the user which eliminate harsh light and unwanted shadowing.

While the invention has been described in the specification and illustrated in the drawings with reference to a preferred embodiment, it will be understood by those skilled in the art that various changes may be made and equivalents may be substituted for elements of the invention without departing from the scope of the claims. In addition, many modifications, for example incandescent lamps, may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. In a tri-view medicine cabinet comprising an open enclosure-forming cabinet having a front edge about said cabinet with at least one central access door having an outer mirrored surface for forming a closure of the cabinet and on each side of said central access door a pivotal side access door having a mirror supported thereon forming a part of the closure of said cabinet for reflecting at least a partial side view of an object positioned before said central access door, the improvement comprising light emitting means comprising a plurality of fluorescent lamp tubes positioned about the entire periphery of said open enclosure-forming cabinet for directing diffused light upon an object positioned before said central access door with a portion of each one of said fluorescent lamp tubes extending beyond said front edge of said open enclosure-forming cabinet to project shadow-free light on an object positioned before said mirrored central access and side access cabinet doors, said plurality of fluorescent lamp tubes being supported in a chase formed as an integral part of said tri-view medicine cabinet by the outer peripheral walls of the enclosure-forming cabinet and finishing panels positioned outwardly about said outer peripheral walls of the enclosure-forming cabinet and spaced therefrom by support panels connected between said outer peripheral walls of the enclosure-forming cabinet and said finishing panels, said finishing panels extending outwardly beyond said front edge of said open enclosure-forming cabinet for directing the light inwardly toward said central access door, and a translucent light diffusing panel means positioned adjacent each one of said plurality of fluorescent lamp tubes for diffusing and distributing the light emitted therefrom.

2. The tri-view medicine cabinet of claim 1 wherein said chase in which said fluorescent lamp tubes are positioned is open in a direction facing the cabinet front and supports said translucent light diffusing panel.

* * * * *